US009789378B1

(12) United States Patent
Threlkeld et al.

(10) Patent No.: US 9,789,378 B1
(45) Date of Patent: Oct. 17, 2017

(54) GOLF TRAINING DEVICE AND METHOD FOR GOLF TRAINING

(71) Applicants: Judson E. Threlkeld, Camas, WA (US); Joe Hare, Seattle, WA (US); Shamus T O'Doherty, Spokane, WA (US); James M. Miller, Bellevue, WA (US)

(72) Inventors: Judson E. Threlkeld, Camas, WA (US); Joe Hare, Seattle, WA (US); Shamus T O'Doherty, Spokane, WA (US); James M. Miller, Bellevue, WA (US)

(73) Assignee: Judson E. Threlkeld, Camas, WA (US)

( * ) Notice: Subject to any disclaimer, the term of this patent is extended or adjusted under 35 U.S.C. 154(b) by 0 days.

(21) Appl. No.: 15/424,189

(22) Filed: Feb. 3, 2017

(51) Int. Cl.
*A63B 69/36* (2006.01)

(52) U.S. Cl.
CPC .. *A63B 69/3608* (2013.01); *A63B 2208/0204* (2013.01)

(58) Field of Classification Search
USPC ..... 473/211–217, 219–224, 266, 268, 269, 473/409
See application file for complete search history.

(56) References Cited

U.S. PATENT DOCUMENTS 5,722,898 A * 3/1998 Witten ..... A63B 69/3608 273/DIG. 17
5,800,278 A * 9/1998 Varriano ..... A63B 69/3608 473/209
6,536,905 B2 * 3/2003 Gibb ..... A63B 57/00 353/84
6,672,972 B1 * 1/2004 Stone ..... A63B 69/3608 362/191
6,733,153 B1 * 5/2004 Lee ..... F21L 4/00 362/191
7,207,896 B1 * 4/2007 Sudol ..... A63B 69/3608 362/106
7,229,361 B1 * 6/2007 Park ..... A63B 69/3608 473/209
8,944,931 B2 * 2/2015 Nell ..... A63B 69/3608 362/191
2003/0045368 A1 * 3/2003 Farmer ..... A63B 69/3608 473/268

(Continued)

OTHER PUBLICATIONS

Janet Pollard, Franklin County Visitors Bureau invites golfers to try the laser cap for improved putting and chipping, prweb.com, Mar. 31, 2016.

(Continued)

*Primary Examiner* — Nini Legesse
(74) *Attorney, Agent, or Firm* — Randall Danskin P.S.

(57) ABSTRACT

A golf training device is described, and which forms an aiming point which is directed towards a golf ball by the correct positioning of a golfer's head and body, and wherein the aiming point assists the golfer in positioning and maintaining the golfer's head and body in an appropriate orientation relative to the golf ball so that the golfer may continually view the aiming point which is directed towards the golf ball through at least a portion of the golf swing of a golfer to strike the golf ball and thereby achieve improved golfing performance.

4 Claims, 13 Drawing Sheets

(56) References Cited

U.S. PATENT DOCUMENTS

| | | | | |
|---|---|---|---|---|
| 2007/0197314 | A1* | 8/2007 | York | A63B 57/00<br>473/407 |
| 2009/0066907 | A1* | 3/2009 | Kopren | A61H 5/00<br>351/45 |
| 2010/0013860 | A1* | 1/2010 | Mandella | G01B 21/04<br>345/650 |
| 2010/0045928 | A1* | 2/2010 | Levy | H04M 1/05<br>351/158 |

OTHER PUBLICATIONS

Screen shots of lasergolfcap.com website, Apr. 20, 2017.

* cited by examiner

GOLF TRAINING DEVICE AND METHOD FOR GOLF TRAINING

TECHNICAL FIELD

The present invention relates to a golf training device and method for golf training, and more specifically to a novel device which, when properly employed, encourages a golfer to maintain a proper body position throughout a golf swing in order to increase the golfer's overall golfing performance.

BACKGROUND OF THE INVENTION

Those skilled in the art will recognize that there are a multitude of devices, and other methodology, which is available and which is useful for improving the performance of golfers during their game. Existing prior art practices include various golf swing aids which often utilize cumbersome equipment, and which further are difficult to transfer to, or use at, a golf course, or further utilize while participating in an actual golf game, or employ at a driving range. Shortcomings with the numerous devices which have been employed, in the past, have included user fatigue; difficulty in transporting the equipment to remote locations; and further, the previous equipment often forces golfers to contort or otherwise position their head, arms and necks into sometimes rigid, and uncomfortable positions which are intended to limit improper movement of these portions of their body while the user utilizes their golf clubs in practice.

In view of these shortcomings, noted above, most conventional pieces of equipment which are employed to improve a golf swing are typically utilized, or confined to a practice or driving range, by necessity. While these prior art devices have operated with varying degree of success, and can, if used properly, assist a golfer in improving their game, the difficulty in utilizing such prior art devices during an actual golf game often results in the golfer reverting back, over time, to bad habits, once they are away from the golf practice or driving range, and are actually playing on a real golf course. Of course, as noted above, the previous prior art devices often are cumbersome, and cannot be easily transported, or utilized, during an actual golf game. In addition to the shortcomings noted in the paragraph, above, many conventional golf swing aids, and methodology, were principally developed to remedy or address one or more physical aspects of a golfer's swing. These physical aspects could include, but are not limited to, slowing or shortening the backswing; reducing body sway; or keeping hands, arms, legs or feet in what is perceived to be an ideal power position; or correctly positioning the club face as seen in U.S. Pat. No. 5,193,812 to Hendricksen. While many of these prior art devices, and methodology, may actually, and temporarily, correct one or more of these physical problems, these prior art devices and practices, however, fail to address or provide any remedy concerning correcting a golfer's visual observation or concentration on the golf ball during a golf swing. As should be appreciated, even assuming that a golfer's physical movements or golf club position may be improved upon, the conventional prior art devices and methodology fail to address or correct a golfer's problems associated with the proper positioning of the head of the golfer and the viewing of the golf ball throughout the golf swing. This lack of visual concentration on the golf ball can significantly impact the performance of a golfer during any golf swing.

A golf training apparatus and methodology for golf training which avoids the detriments associated with the prior art devices, and practices, utilized heretofore, is the subject matter of the present Application.

SUMMARY OF THE INVENTION

A first aspect of the present invention relates to a golf training device which includes an aiming assembly having an aiming point, which is further directed toward a golf ball by the correct positioning of a golfer's head and body, and wherein the aiming point assists the golfer in positioning, and maintaining the golfer's head, and body, in an appropriate orientation relative to the golf ball so that the golfer may continually view the aiming point which is directed toward the golf ball throughout at least a portion of a golf swing of a golf club by the golfer to strike the golf ball; and a mounting assembly for releasably mounting the aiming assembly on the head of the golfer.

Another aspect of the present invention relates to a golf training device which includes an aiming assembly having an aiming point which is directed toward a golf ball, and wherein the aiming point assists a golfer in positioning, and maintaining a golfer's head, and body, in an appropriate orientation relative to the golf ball so that a golfer may continually view the aiming point which is directed toward the golf ball throughout a portion of a golf swing, and until the golfer strikes the golf ball with a golf club which is being swung by the golfer, and wherein the aiming assembly includes a selectively energizable light emitting device which emits a light beam which is pointed at the golf ball to be struck, and which forms the aiming point on the golf ball, and wherein the aiming point may be visibly discerned by an eye of the golfer, and wherein the light emitting device further comprises a tilt sensor which is made integral with the light emitting device, and wherein the tilt sensor selectively energizes the light emitting device only when the light emitting device is located in a non-horizontal orientation, and pointed generally downwardly, and in the direction of the golf ball which is resting on an underlying supporting surface, and further deenergizes the light emitting device when the light emitting device moves towards a horizontal orientation; and an angularly adjustable mounting assembly for releasably mounting the aiming assembly on the head of the golfer.

Still further another aspect of the present invention relates to a golf training method which includes providing an aiming assembly which forms a visibly discernible aiming point; adjustably positioning the aiming assembly on a head of a golfer; training the aiming point formed by the aiming assembly onto a golf ball which is to be struck by a golfer swinging a golf club during a golf swing by orienting a body, and the head of the golfer, in an appropriate standing position relative to the golf ball, and with the head of the golfer in a down, and relatively motionless position, so that the aiming point is visually directed onto the golf ball which is to be struck by the golf club during the golf swing, and which further can be visually discerned by the golfer; and moving the golf club through the golf swing so as to impact the golf ball while simultaneously visually maintaining the aiming point formed by the aiming assembly trained on the golf ball throughout at least a portion of the golf swing, and at least until the golf club impacts the golf ball, and wherein the golf training device encourages the golfer to maintain the golfer's head, and body, in the appropriate standing position, and with the head of the golfer in the down, and relatively motionless position relative to the golf ball, and during the golf swing, so as to achieve improved golfing performance.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
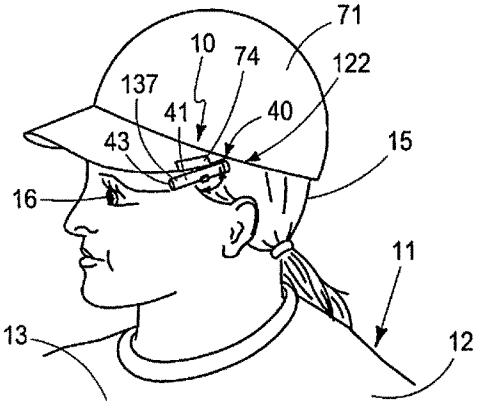
FIG. 1 is a partial, side elevation view of a golfer's head showing the invention mounted on a piece of clothing, and a light emitting device which forms a feature of the present invention when it is in a deenergized operational state.

The present invention is generally indicated by the numeral 10, in FIG. 1, and following. As best understood by a study of the drawings (FIG. 12-19), the golf training device 10 is employed by the golfer 11 in a manner which assists or otherwise encourages the golfer to position and maintain the golfer's body 12, which includes the torso 13, arms 14, and head 15, in an appropriate orientation relative to a golf ball 20 so that the golfer 11 may continually view the golf ball 20 during at least a portion of a golf swing.

As seen in the drawings which are provided, the golfer 11, when utilizing the golf training device 10 will position their body 12 (FIG. 12) in an appropriate orientation relative to a golf ball 20, that needs to be struck by a golf club 30. The golfer 11 will utilize their arms 14 to grasp the golf club 30, and thereafter the golfer 11 will position their head 15, in an appropriate, down orientation, as seen in the drawings (FIG. 12-19), and will direct their eyes 16, and their field of view/line of sight 17, onto the golf ball 20 which has been appropriately teed up to be struck by the golf club 30.

Figure 2:
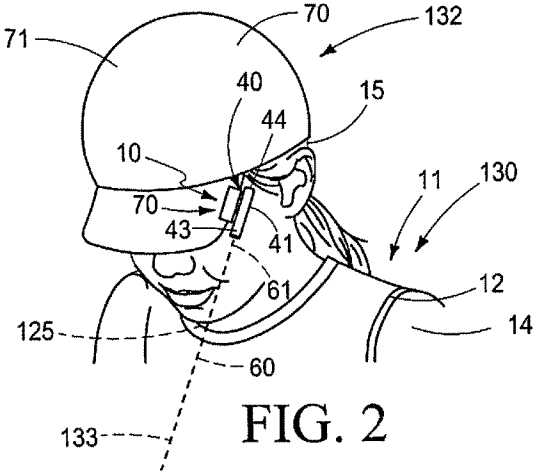
FIG. 2 is a partial, side elevation view of a golfer's head in a correct, down position, and the light emitting device, which forms a feature of the invention in an energized operational state.
Figure 11:
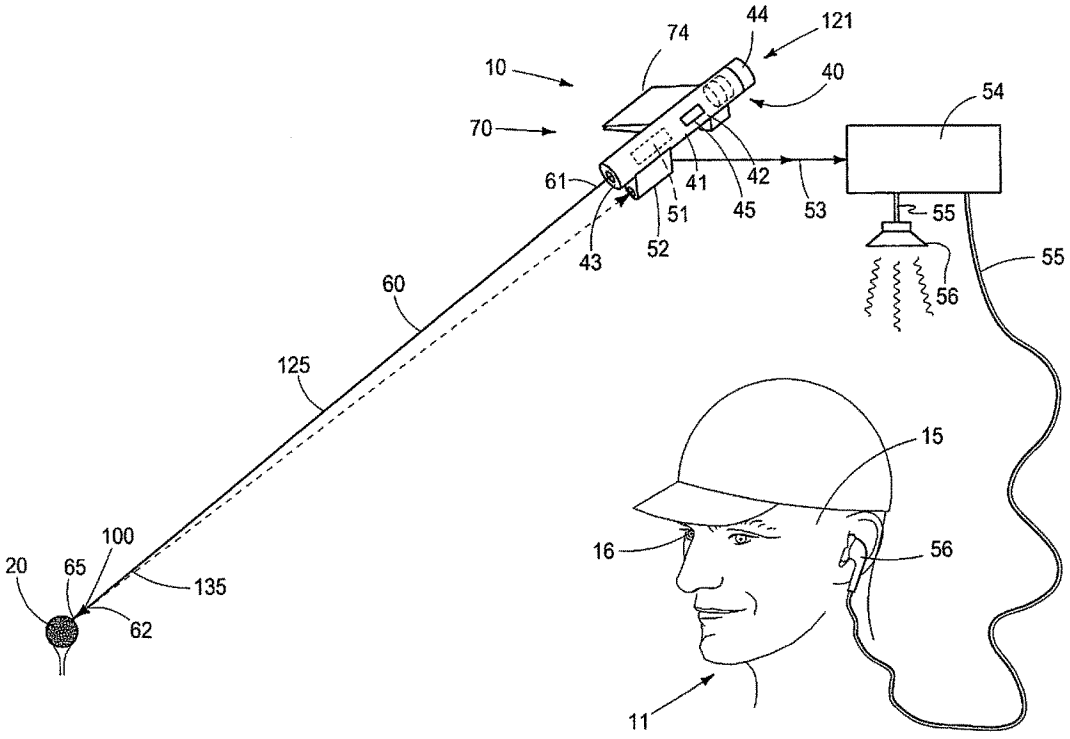
FIG. 11 is a greatly simplified view of the present invention, and which includes an audio delivery device which is utilized by the golfer.
Figure 12:
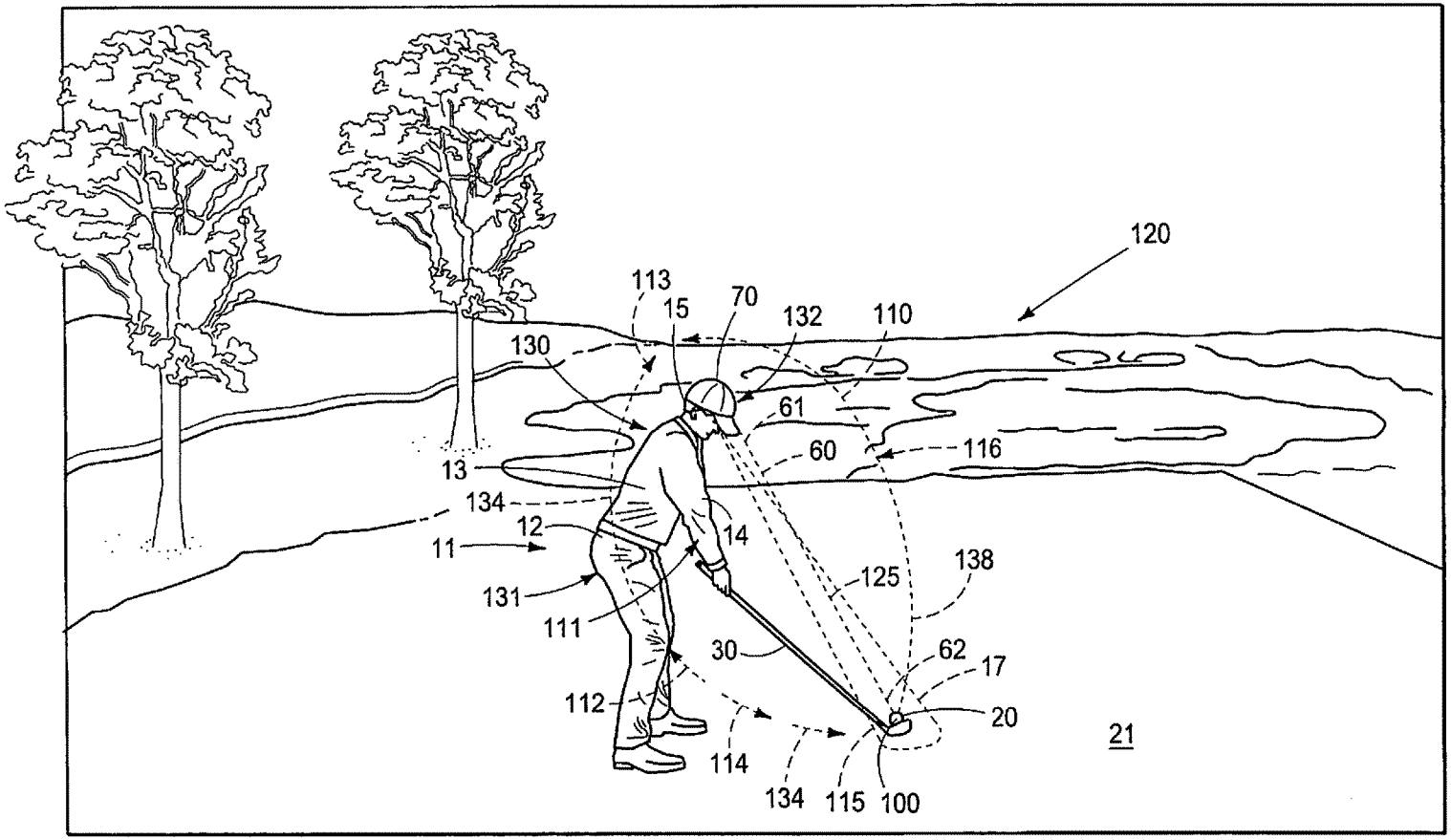
FIG. 12 shows a golfer employing the methodology of the present invention, and where the golfer is in a setup position to execute a golf swing.
Figure 13:
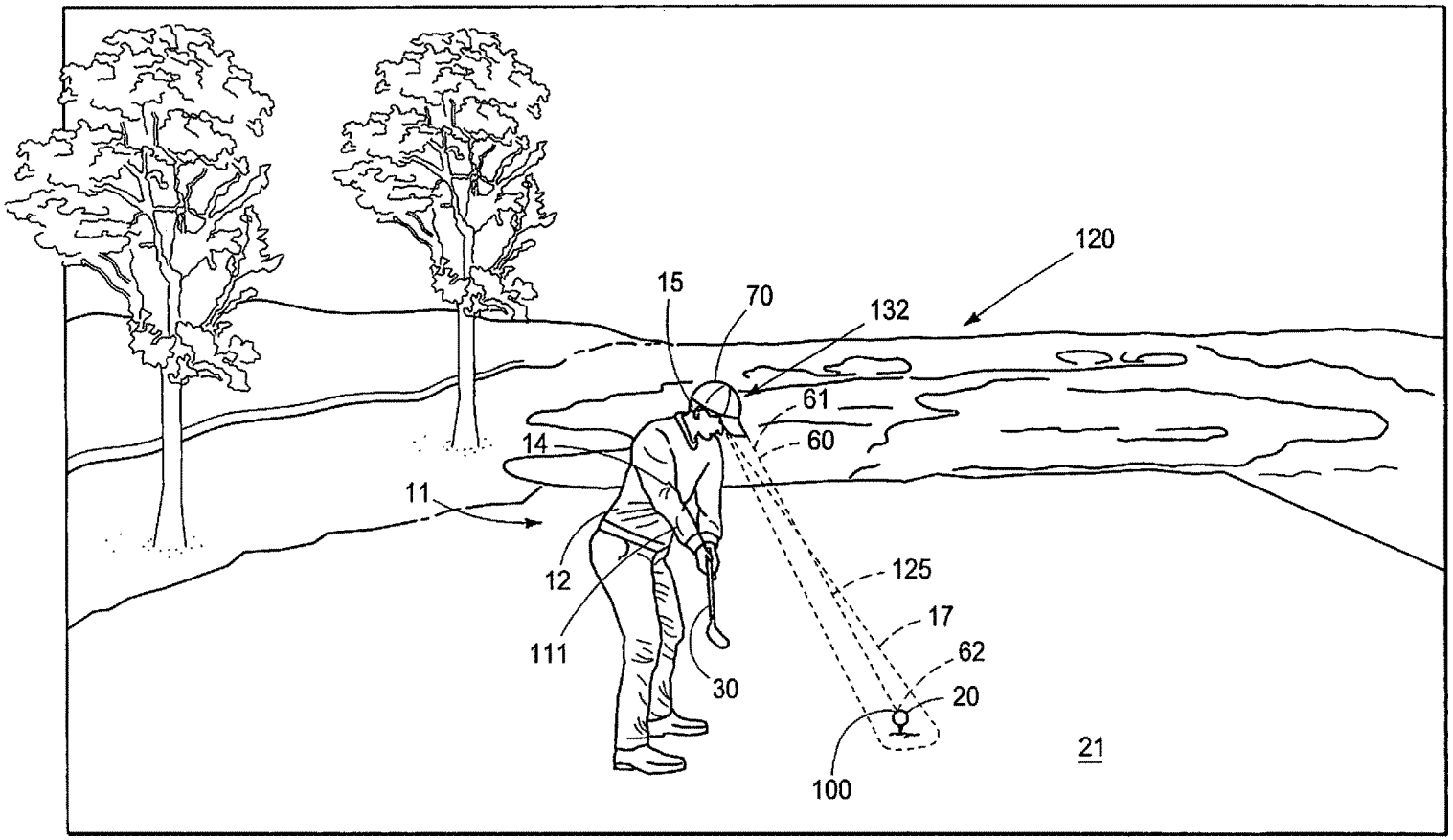
FIG. 13 shows a golfer employing the methodology of the invention, and where the golfer is beginning the backswing portion of a golf swing.
Figure 14:
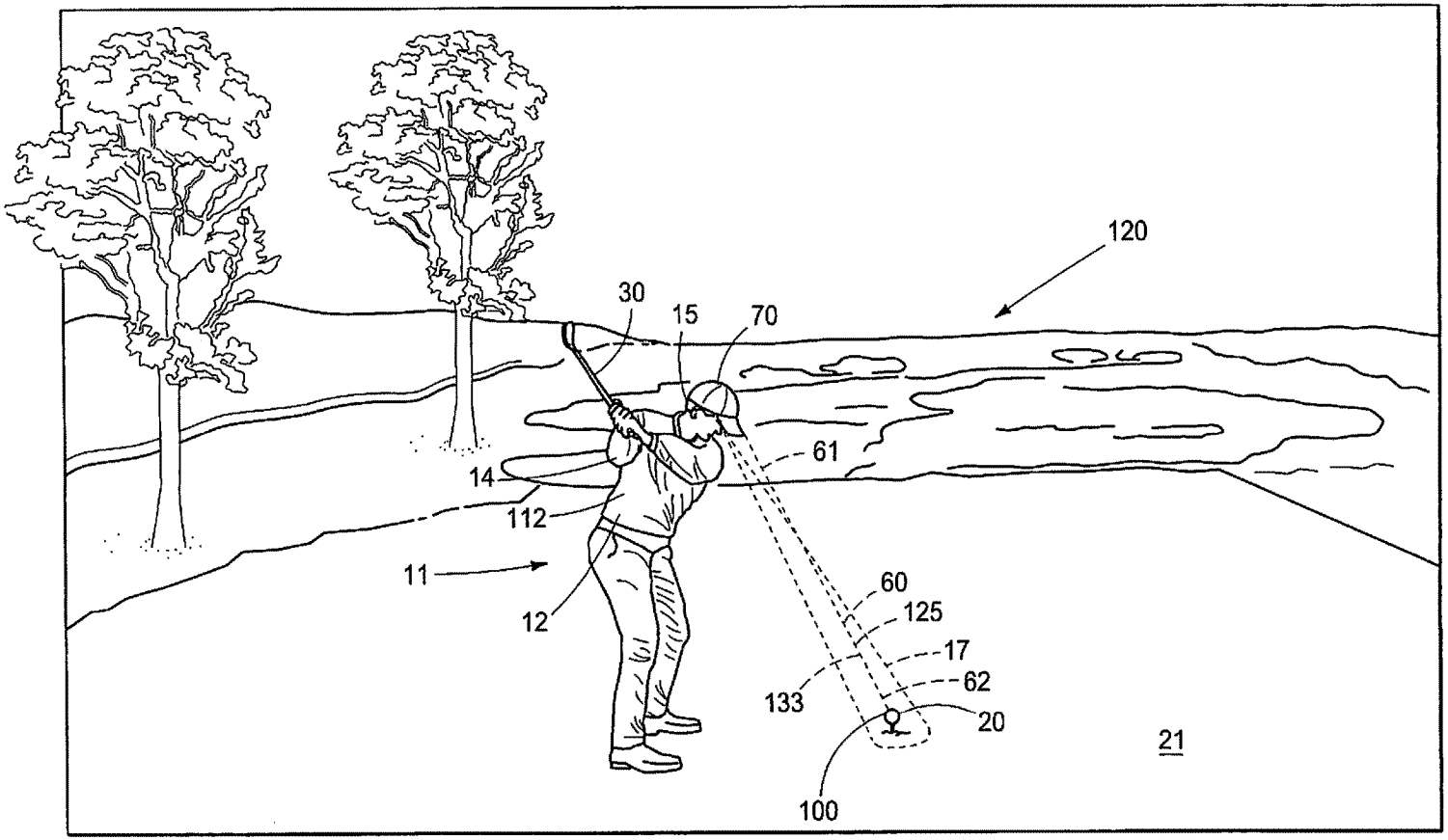
FIG. 14 shows a golfer employing the methodology of the invention, and where the golfer is continuing to move the golf club through or along a backswing.
Figure 15:
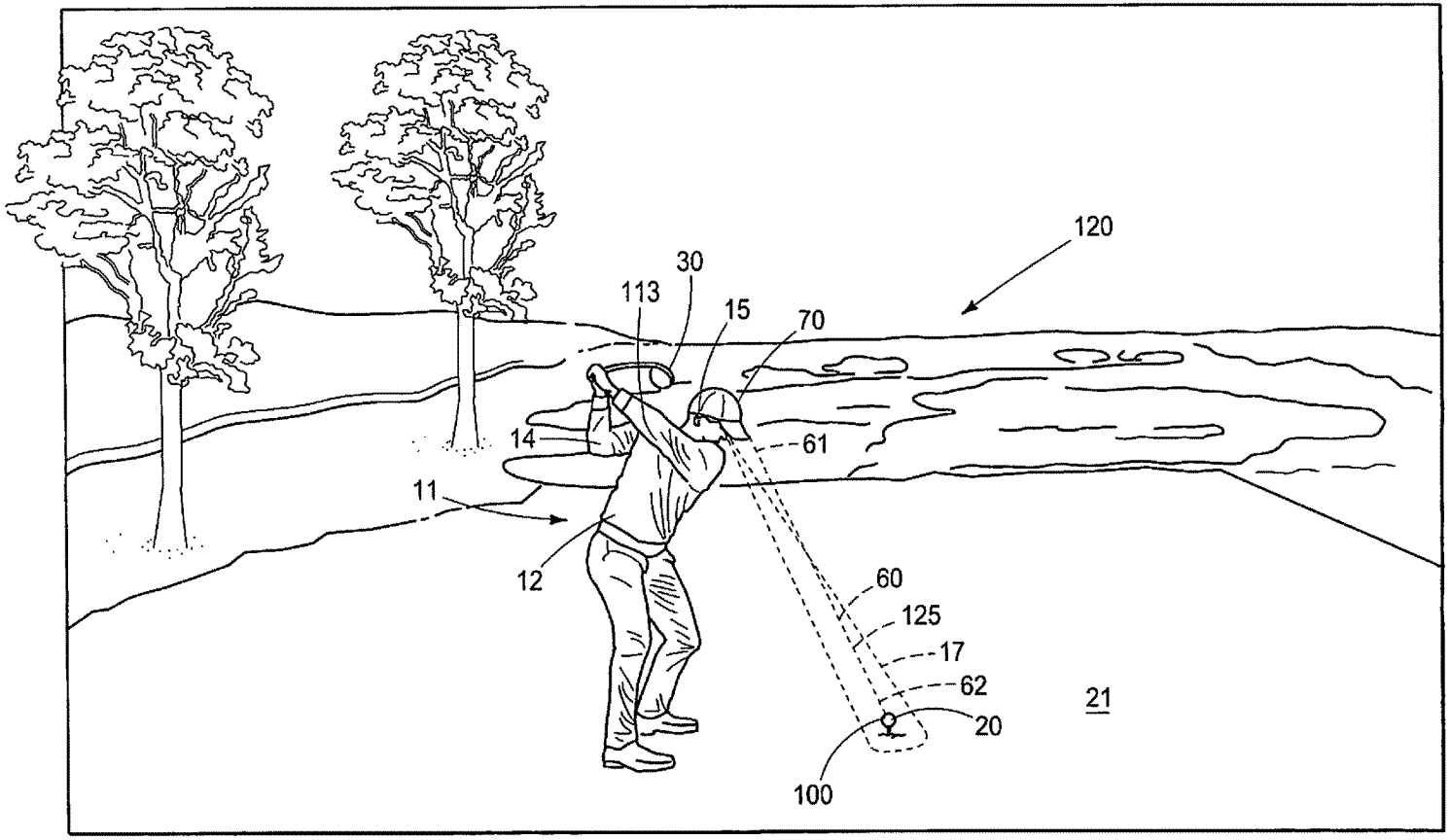
FIG. 15 shows a golfer employing the methodology of the invention, and where the golfer has positioned the golf club at the apex of the backswing.
Figure 16:
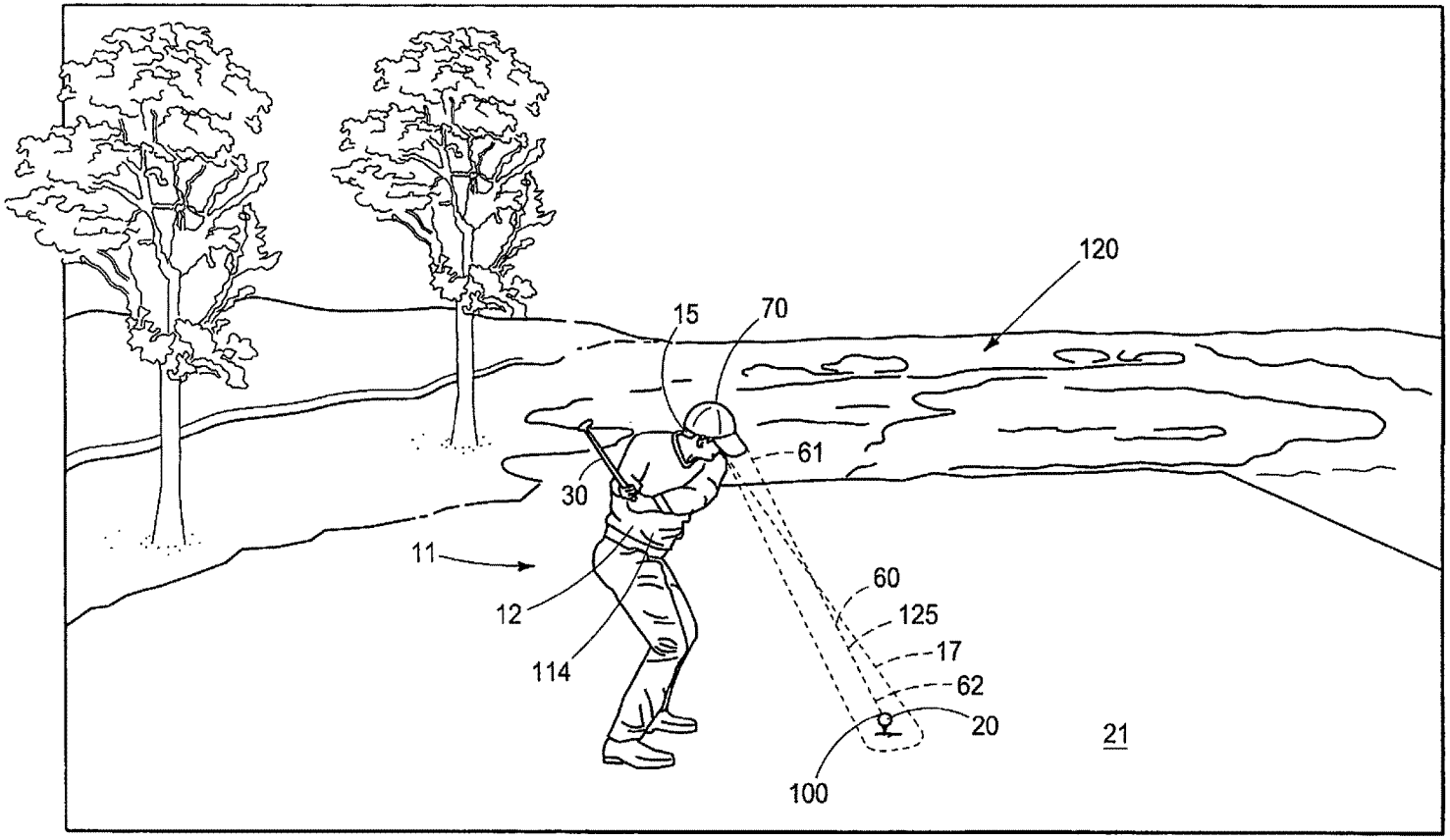
FIG. 16 shows a golfer employing the methodology of the invention, and where the golfer is beginning to swing the golf club along the downswing portion of the golf swing.

The golf training device 10 includes an aiming assembly which is generally indicated by the numeral 40. The aiming assembly 40, in one form of the invention (FIGS. 1, 2 and 6) utilizes a selectively energizable light emitting device 41, here depicted as a relatively small, and lightweight, laser which will be discussed in detail, below. The selectively energizable light emitting device 41 has an elongated main body 42 which has a first light emitting end 43, when energized, and a second, distal end 44. An electrical power switch 45 is made integral with the main body 42, and which may be forcibly engaged by the golfer 11 in order to selectively energize the light emitting device 41. The light emitting device 41 further includes an electrical power source which is generally indicated by the numeral 46, and which is illustrated, in phantom lines, as being a multiplicity of conventional button batteries. The electrical switch 45 for selectively energizing the light emitting device may be placed on the main body 41 at about any location but generally speaking it may be useful to place the electrical switch 45 along the main body 42. The selectively energizable light emitting device 41, and which takes the form of a laser, incorporates within the main body 42, an internal, tilt sensor 51, which is well known in the art. The tilt sensor 51 is made operably integral with the light emitting device 41, and further selectively energizes the light emitting device only when the light emitting device is located in a non-horizontal orientation, and pointed generally downwardly in the direction of the golf ball 20 (FIG. 2). As seen in the drawings which are provided, the golf ball 20 is resting on an underlying supporting surface 21. The tilt sensor 51 further deenergizes the light emitting device 41 when the light emitting device 41 moves toward a horizontal orientation (FIG. 1). The operational attributes of the tilt sensor 51 provides several advantages. One of the chief advantages of the tilt sensor 51 is that it operates as a safety device so as to prevent an inadvertent delivery of the light generated by the light emitting device 41 into the eyes of adjacent golfers or other bystanders. This is particularly important if the light emitting device happens to be a laser, and where a direct shining of an emitted laser light into the eye of an adjacent individual may cause optical damage to the recipient's eyes. Secondly, the tilt sensor 51 operates to preserve the battery life of the light emitting device 41. Thirdly, and most importantly, this tilt sensor encourages the golfer 11 to maintain their head 15, down, and motionless during at least a portion of the golf swing. In addition to the foregoing, and in another form of the invention (FIG. 11), the selectively energizable light emitting device 41 mounts a light receiving sensor 52. The light receiving sensor provides an electrical output signal, which is generally indicated by the numeral 53, and which further is supplied either by an electrical conduit, or wirelessly, to an audio receiver 54. The audio receiver 54 is operable to produce an audio output 55 which is then delivered to a sound reproducing device such as a speaker, earbuds, or the like 56, and which may be utilized by the golfer 11. The operation of this particular form of the invention will be discussed in greater detail, below.

Figure 6:
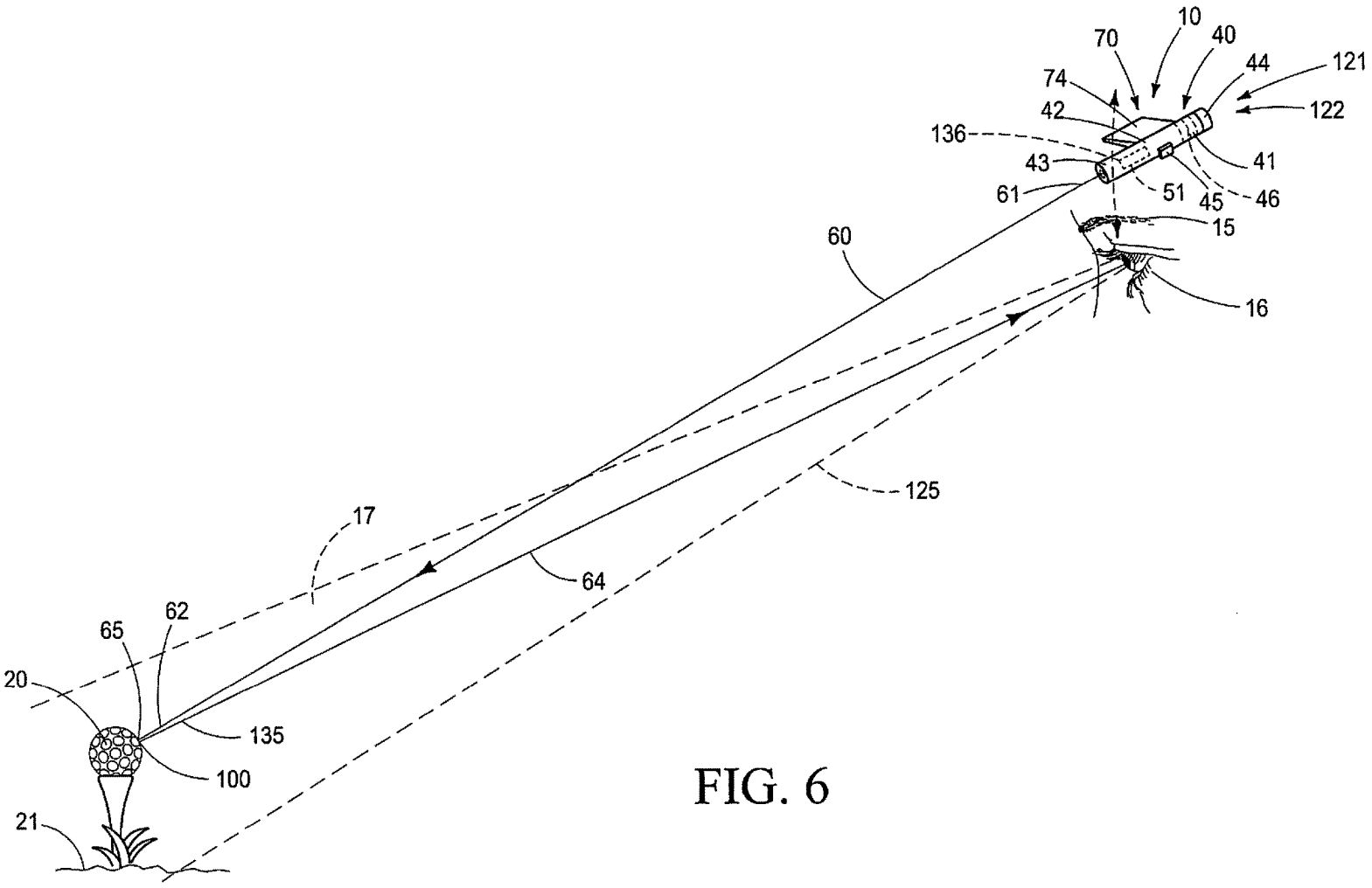
FIG. 6 is a fragmentary, greatly simplified view of the present invention, and which illustrates certain operational aspects of the invention.

In the form of the invention as discussed in the paragraphs, above, the selectively energizable light emitting device 41 produces a light beam 60, which is directed towards, and onto, the golf ball 20 which is to be struck (FIG. 6). The light beam 60 which is generated by the light emitting device 41, has a proximal end 61, and an opposite, distal second end 62 which strikes the golf ball 20 sitting on the underlying supporting service 21, and forms an illuminated region 65 having a predetermined cross-sectional dimension. The light beam 60, in one possible form of the invention (FIGS. 10A and B), is selectively adjustable so that the cross-sectional dimension 63 of the light beam may be changed. Further the light beam 60 which strikes the golf ball 20 forms a reflected light beam 64 (FIG. 6) which is directed back in the direction of the golfer's eyes 16, and within the golfer's field of view, or line of sight which is generally indicated by the numeral 17. Further, this reflected light beam 64 will be received, at least in part, by the light sensor 52. When the light sensor 52 no longer detects the reflected light beam 64 from the golf ball 20 the sensor 52 sends a signal 53 to the audio receiver 54. The resulting audio output 55 then alerts the golfer 11 that his/her head 15 has change from the correct, down position which is necessary to execute a correct golf swing.

Figure 3:
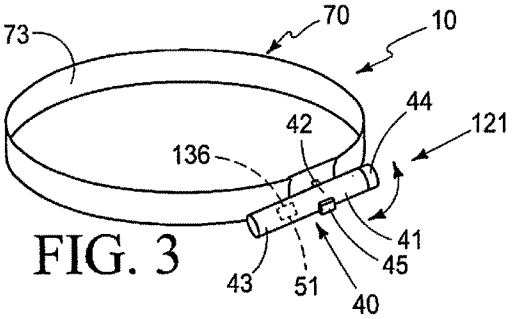
FIG. 3 is a perspective, side elevation view of one form of the present invention.
Figure 4:
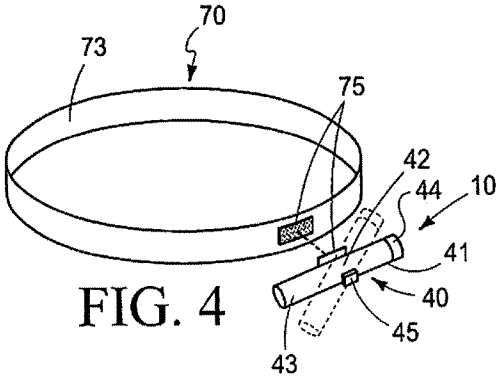
FIG. 4 is a perspective, exploded view of a second form of the present invention.
Figure 5:
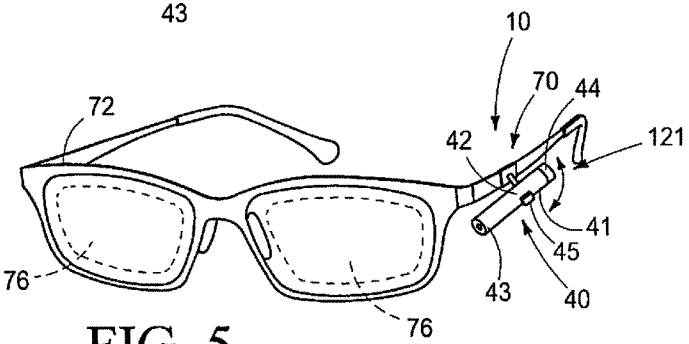
FIG. 5 is a perspective, side elevation view of another possible form of the present invention.

The golf training device 10 further includes a mounting assembly 70 for releasably mounting the aiming assembly 40 on the head 15 of the golfer 11. The mounting assembly 70 permits or facilitates the selective angular adjustment of the light emitting device 41 relative to the golfer's head 15, so as to allow the light beam 60 to be trained upon the golf ball 20, when the golfer's body 12, and head 15, are oriented in appropriate positions relative to the golf ball 20 to be struck. In this regard, this position of the golfer 11 would include an orientation of the golfer's body 12, and head 15, so that the eyes 16 of the golfer 11, and the light beam 60, is trained on the golf ball 20 while the golfer's head 15 is in a substantially motionless, and downwardly oriented position relative to the golf ball 20. This is clearly seen by reference to FIG. 12. Still further, the adjustable mounting assembly 70 allows for the selective adjustment of the aiming assembly 40 so that the golf training device 10 can be utilized by a golfer having different physical heights, and arm lengths. The mounting assembly 70 may be releasably affixed to the golfer's head 15, by a piece of clothing, here depicted as a hat 71 (FIGS. 1 and 2); eyewear worn by the golfer 72 (FIG. 5); or perhaps even to a supporting headband which is generally indicated by the numeral 73, and which may be worn about the head of the golfer 15, or worn over the top of the piece of clothing, here depicted as a hat 71 (FIGS. 3 and 4). The mounting assembly 70 may take on several different forms including a spring biased clamp having a pivot point 74 (FIGS. 1 and 2), and which can be utilized, for example, to grasp the brow of the hat 71, or a hook and loop type fastener arrangement 75 as might be utilized with a supporting headband, and which is generally indicated by the numeral 73 (FIGS. 3 and 4). With regard to the supporting headband 73, the supporting headband can be rendered adjustable, as to length, by using a suitable fastening technique such as by employing a hook-and-loop type fastener arrangement. Further a similar arrangement could be employed so that the main body 42 of the aiming assembly 40 is positioned in an appropriate orientation relative to the head 15 of the golfer 11 so that the resulting light beam 60 can be directed downwardly, and onto the golf ball 20, when the golfer's body 11 is appropriately positioned, and the golfer's head 15, is in a suitable, down position, so that the golfer's eyes 16 may see the reflective light beam 64 within their field of view or line of sight 17 (FIG. 4).

In the form of the invention, as shown in FIG. 6, the selectively energizable light emitting device 41 produces a light beam 60 which is pointed at the golf ball 20 to be struck, and which forms an aiming point, as will be discussed, below, on the golf ball 20, and wherein the aiming point may be visibly discerned by an eye 16 of the golfer 11. As noted above, the light beam 60 in this form of the invention may be generated by a commercially available laser which has a predetermined color. Still further, the aiming point, as will be discussed, below, and which is formed by the light beam on the golf ball 20, can be visibly discerned by the golfer unaided under typical ambient lighting conditions. One particularly describable color is the color green, which can usually be seen under most ambient lighting condition.

In one possible form of the invention 10 (FIG. 5) the light beam 60 is emitted by a light emitting device 41, such as a laser, and which has a predetermined color which can only be visibly discerned by the golfer 11 with the aid of a predetermined optical filter 76 as might be incorporated into the eyewear 72, which is worn on the head 15, of the golfer 11. Still further, this optical 76 filter may be incorporated into some other vision appliance which might be worn by the golfer such as a virtual reality head set (FIG. 7) as will be discussed in greater detail, below. As noted earlier, the selectively energizable light emitting device 41 includes a tilt sensor 51 which selectively energizes the light emitting device 41, or laser, only when the light emitting device 41 is located in a non-horizontal orientation (FIG. 2) and pointed generally downwardly in the direction of the golf ball 20, and which is resting on the underlying surface 21. Still further, the tilt sensor 51 deenergizes the light emitting device or laser 41 when the laser moves towards a horizontal orientation (FIG. 1).

Figure 9:
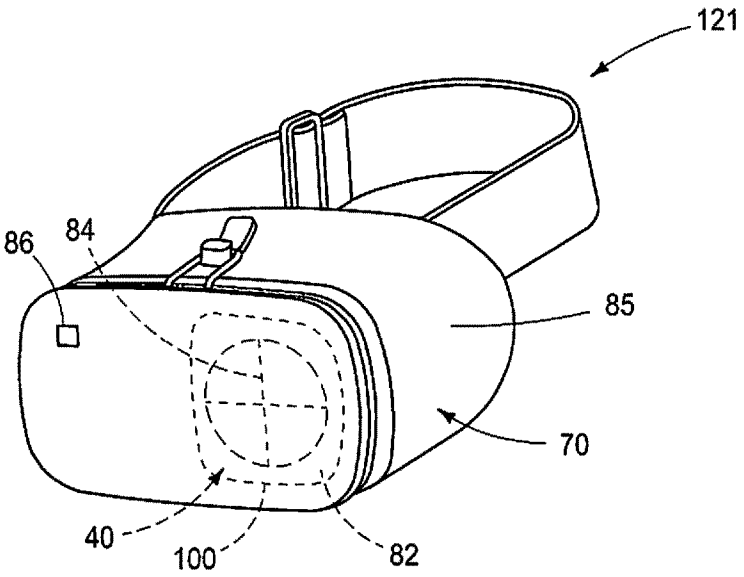
FIG. 9 is a greatly simplified, perspective side elevation view of yet another possible form of the invention.
Figure 7:
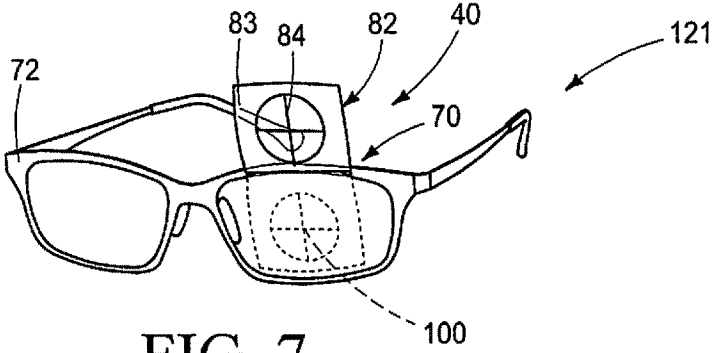
FIG. 7 is a greatly simplified, perspective, side elevation view of another form of the present invention.
Figure 8:
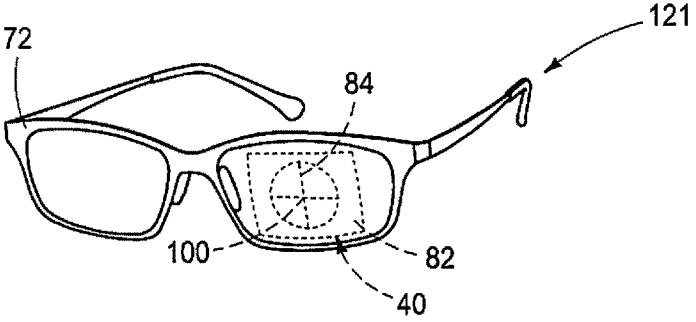
FIG. 8 is a greatly simplified, perspective, side elevation view of another form of the present invention.

A second possible form of the invention includes the use of a reticle 82, and which is seen in FIGS. 7 through 9. In this regard the reticle 82, in one form of the invention, is made integral with a transparent substrate 83 (FIG. 7), and through which the golfer 11 views through with at least one of their eyes 16. The reticle 82 takes on the form of a traditional cross-hair arrangement 84. The cross-hairs 84 may be fabricated from extremely thin and strong wires that are flattened to various degrees to change their widths. These wires are typically silver in color, but appear black when backlit by the image passing through the transparent substrate 83. The reticle 82 may also be formed by etching the cross-hair arrangement 84 into the transparent substrate 83 (FIG. 8). Moreover, illuminated reticles 82 may be formed, and wherein a plastic or fiberoptic light pipe which collects ambient, and/or other light generated by a battery may be provided (now shown). With regard to illuminated reticles, the color red is the most common color used as it is usually least destructive of a viewer's night vision. However, some products may use green or yellow illumination which may be either a single color or which may be variable based upon the user's needs. Other reticles are possible including a collimated reticle, and holographic reticles (not shown), but which are well known in gun sights of various types. In the present invention 10, as seen in the drawings, the reticle 82 may be formed into a lens which is mounted within the eyewear 72 that is worn by the golfer 11 (FIG. 8), or further may be a separate assembly which may be releasably mounted on the eyewear 72 (FIG. 7), and then may be easily flipped or moved into an orientation so that the vision of one of the eyes 16, of the golfer 11 passes through the reticle. In another form of the invention as seen in FIG. 9, the reticle may be generated electronically in a virtual reality headset, and which is generally indicated by the numeral 85. The virtual reality headset 85 would be worn on the head 15, and over the eyes 16, of the golfer 11, and thereafter the camera 86, which is made integral with a portion of the virtual reality headset, would image the underlying supporting surface 21, and the golf ball 20, that is teed-up on same, and thereafter the reticle, generated by the virtual reality headset 85 could be utilized by the golfer as the aiming assembly 40.

Figure 17:
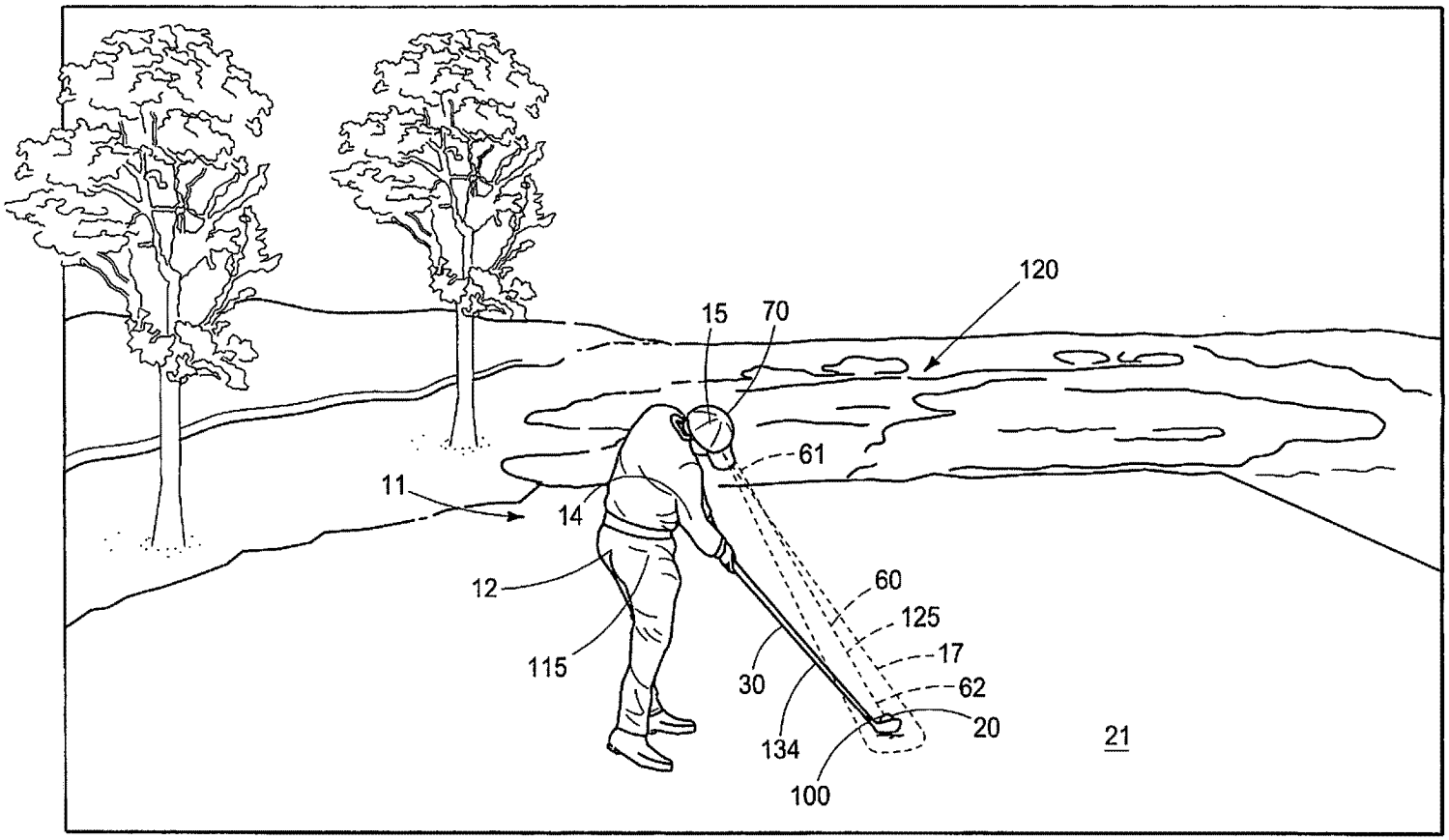
FIG. 17 shows a golfer employing the methodology of the invention, and where the golfer has moved the golf club to the end of the downswing portion of the golf swing, and has further positioned the golf club to impact, or address the golf ball.
Figure 18:
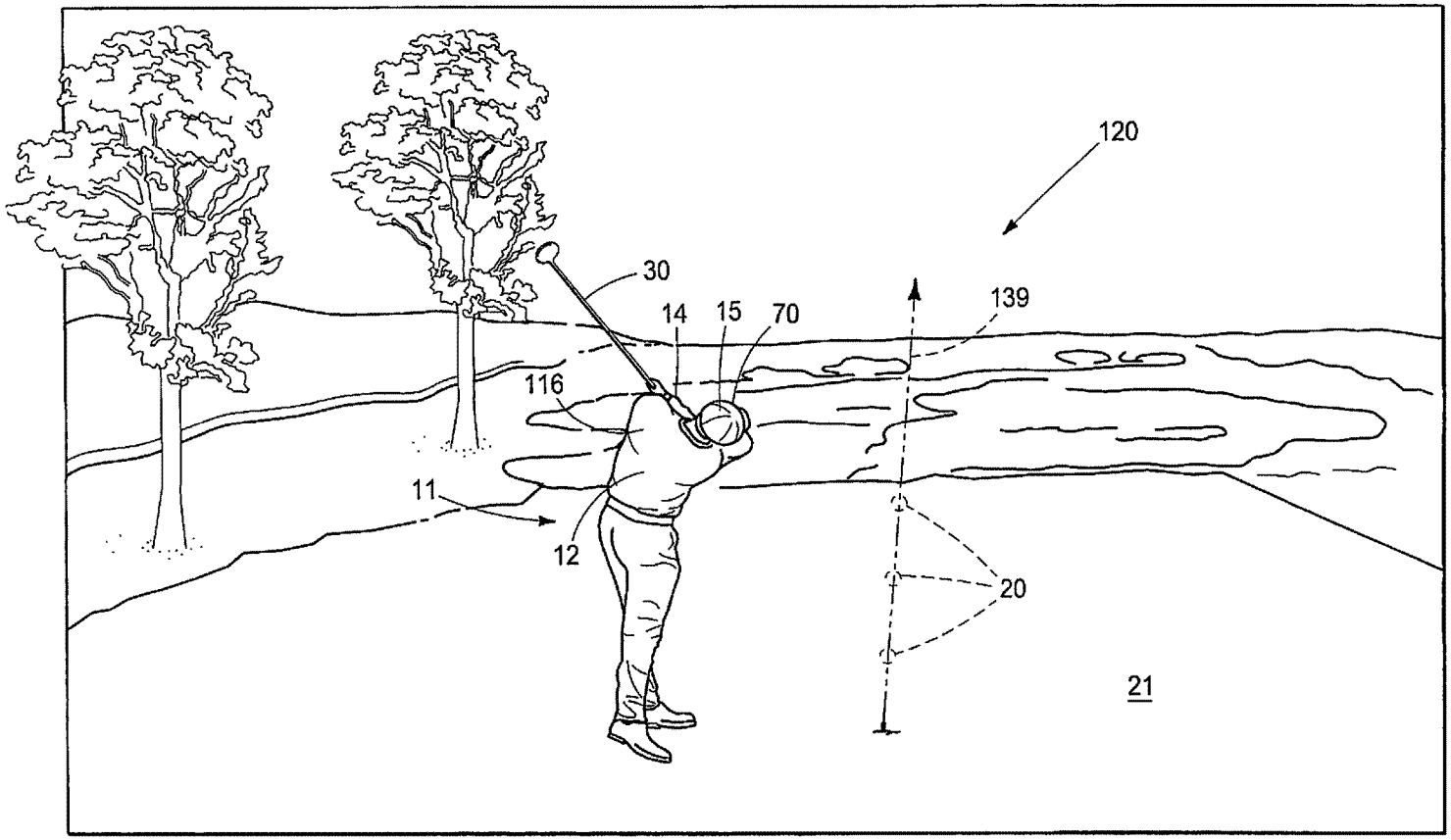
FIG. 18 shows a golfer employing the methodology of the invention, and where the golfer is moving the golf club along the follow-through portion of the golf swing.
Figure 19:
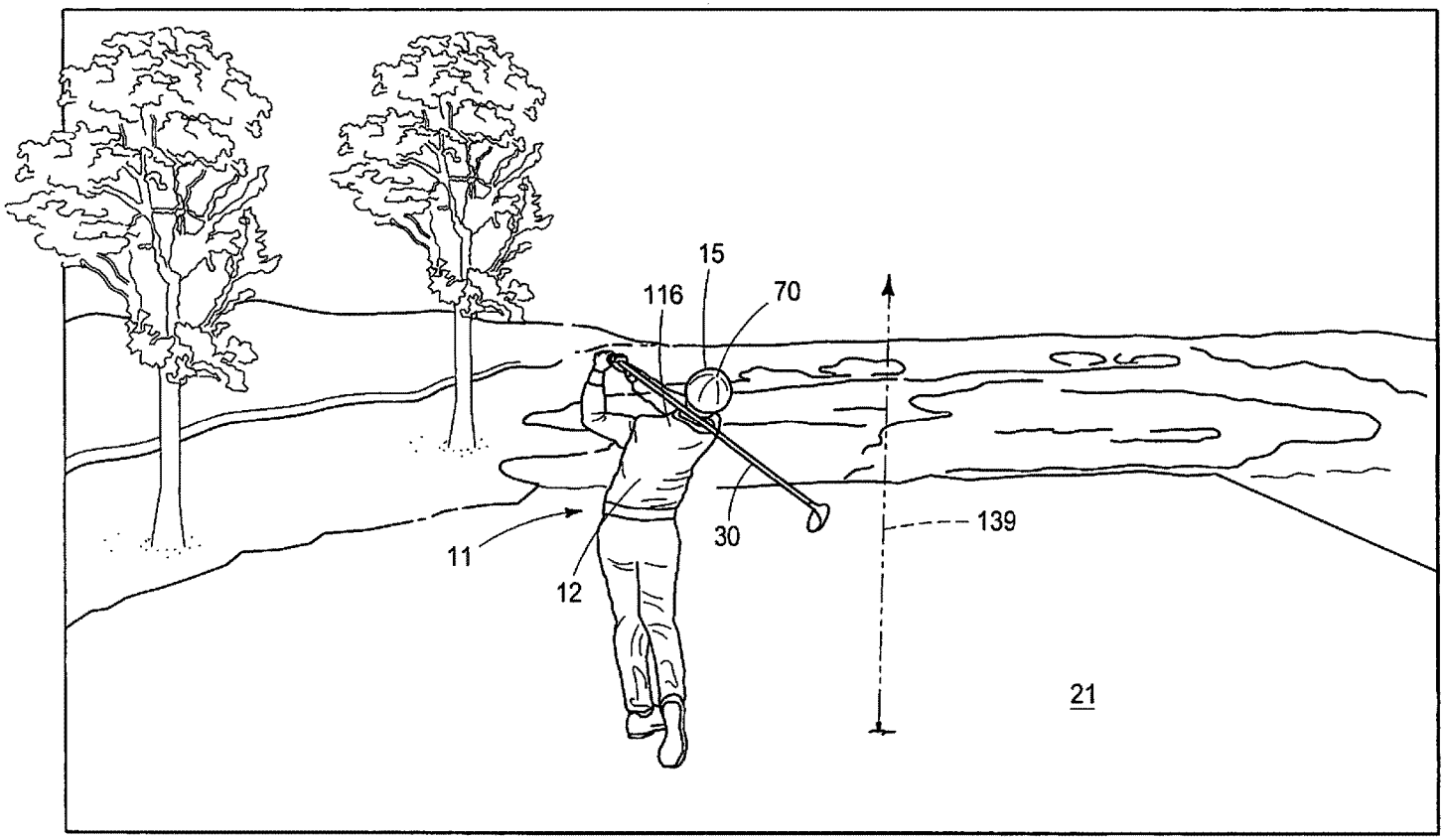
FIG. 19 shows a golfer employing the methodology of the invention, and where the golfer has moved the golf club to the termination of the follow-through portion of the golf swing.

With respect to each form of the invention, as described, and which concerns the aiming assembly 40 which is utilized, each aiming assembly, whether the selectively energizable light emitted device 41, or reticle 82, has or produces an aiming point 100 which is directed toward the golf ball 20 by the correct positioning of the golfer's head 15, and body 12. The aiming point 100 assists the golfer 11 in positioning, and maintaining, the golfer's head 15, and body 12, in an appropriate orientation relative to the golf ball 20 so that the golfer may continually view the aiming point 100 which is directed towards the golf ball 20 throughout at least a portion of a golf swing 110, of the golf club 20, by the golfer 11 to strike the golf ball 20 (FIGS. 12-19). The golf swing 110 (FIG. 12) is formed, or defined by several discrete portions which include a beginning, or set up position 111 (FIG. 12), and wherein the golfer 11 is oriented to address the golf ball 20; a backswing 112 (FIGS. 13-15) which extends from the setup position 111 backward, and upwardly relative to the golfer 11 to an apex position 113, and where the golf club 30 is positioned above the head 15 of the golfer 11; a downswing portion 114 (FIGS. 15-17) which extends from the apex 113, to the golf ball impact 115; and a follow-through portion 116, and which extends from the impact 115, to a location forwardly, and to the rear of the golfer 11 (FIGS. 17-19). The golf swing 110 is performed by the golfer 11 with a traditional golf club 30.

As should be understood from the drawings, the golf training device 10 includes an aiming assembly 40, and in one form of the invention, the aiming assembly may include a reticle 82 which defines the aiming point 100 (FIGS. 7-9). In utilizing this form of the invention the golfer 11 visually trains the aiming point 100, defined by the reticle, by way of the movement of the head 15 or body 12, of the golfer 11, onto the golf ball 20 which is to be struck. As earlier discussed the reticle 82 may be made integral with a vision appliance such as a piece of eyewear 72 which is worn by the golfer 11 (FIG. 8). Still further, in one possible form of the invention, the reticle may be made integral with a transparent lens 83 which is worn over an eye 16, of the golfer 11 (FIG. 8). Still further, and as earlier discussed, the reticle 82 may be generated by a virtual reality headset 85 which is worn on the head 15 of the golfer 11 (FIG. 9). Additionally, as noted earlier, the reticle 82 may comprise a holographic reticle which is well known.

The golf training device 10, as described, above, can be utilized in a golf training method which is generally indicated by the numeral 120, and which is further seen in FIGS. 12 through 19. In this regard, the golf training method 120 includes a step 121 of providing an aiming assembly 40, which forms a visibly discernable aiming point which is generally indicated by the numeral 100 (FIG. 6). Still further the golf training method includes another step 122 of adjustably positioning the aiming device 40 on a head 15 of a golfer 11 (FIG. 1). The method includes yet another step 125 (FIGS. 2 and 6) of training the aiming point 100 forming the aiming assembly 40, onto a golf ball 20 which is to be struck by a golfer 11, and swinging a golf club 30 during a golf swing 110, by orienting 130 a body 12 and the head of the golfer 15 in an appropriate standing position 131 relative to the golf ball 20, and with the head of the golfer 15 in a down and relatively motionless position 132, so that the aiming point 100 is visually directed 133 (FIG. 14) onto the golf ball 20, which is to be struck 115, by the golf club 30 during the golf swing 110, and which further can be visually discerned by the golfer 11. The method 120 includes another step of moving 134 the golf club 30 so as to impact the golf ball 20, while simultaneously, visually maintaining the aiming point 100 trained on the golf ball 20 for at least a portion of the golf swing 110 (FIG. 12), and at least until the golf club 120 impacts 115 the golf ball 20. The golf training device 10 encourages the golfer 11 to maintain the golfer's head 15, and body 12, in an appropriate standing position 131, and with the head 15 of the golfer 11 in the down, and relatively motionless position 132 relative to the golf ball 20, and during the golf swing 110, so as to achieve improved golfing performance.

The golf training method 120 of the present invention, and which includes the step of providing 121 an aiming device 40, further includes providing a selectively energizable light emitting device 41 which emits a light beam 60, and which further is visually pointed or trained 125, at the golf ball 20 to be struck 115 by moving the head 15 of the golfer 11. The method includes another step 135 of forming a visible aiming point 100 on the golf ball 20, and which is visibly discernable by an eye 16 of the golfer 11 (FIG. 6).

The golf training method 120 of the present invention, and which includes the step 125 of emitting a light beam 60 which is visually pointed or trained at the golf ball 20, includes emitting the light beam 60, with a laser 41, and which has a predetermined color. The visible aiming point 100 which is formed by the light beam 60 on the golf ball 20, can be visibly discerned by the eye 16 of the golfer 11, unaided, under typical ambient lighting conditions (FIG. 6).

The golf training method 120 of the present invention further includes a step 136 of providing a tilt sensor 51 which is made operably integral with the light emitting assembly or laser 41, and which selectively energizes a laser 41, for example, to produce the light beam 60; energizing the laser or selectively energizable light emitting device 41 by way of the operation of the tilt sensor 51, by locating 133 the laser 41 in a non-horizontal orientation, and pointed generally downwardly, and in the direction of the golf ball 20 which is resting on an underlying supporting surface 21 (FIG. 2); and deenergizing 137 the laser 41, by the operation of the tilt sensor 51 by locating the laser in an increasing horizontal orientation (FIG. 1). As noted earlier in this application, this feature provides several advantages, the first being a safety feature which prevents the golfer 11 from striking adjacent individuals in the eye with an energized laser; and secondly, this prolongs the battery life for the laser while it is in operation and energized. This feature also encourages the golfer to keep their head 15 down, and motionless.

The golf training method 120 of the present invention includes another step and wherein the step of moving the golf club 30, through the golf swing 134 further includes moving the golf club 30 along a given path of travel, and into forcible contact 115 with a golf ball 20 so as to cause the golf ball 20 to subsequently travel along a flight path 139 which is generally co-linearly and outwardly oriented relative to the path of travel of the golf club 30 moving along the golf swing 134, and while the golfer 11 visually maintains 125 the aiming point 100 formed by the aiming device 40 trained on the golf ball 20.

OPERATION

The operation of the described embodiments of the present invention are believed to be readily apparent, and are briefly summarized at this point. In its broadest aspect a golf training device 10, and related methodology 120 is described, and which includes an aiming assembly 40 having an aiming point 100 which is directed or trained 125, toward a golf ball 20 by the correct positioning 132 of a golfer's head 15, and body 131, and wherein the aiming point 100 assists the golfer 11 in positioning, and maintaining the golfer's head 15 and body 12 in an appropriate orientation 131, 132 relative to the golf ball 20 so that the golfer 11 may continually view the aiming point 100 which is directed toward the golf ball 20 throughout at least a portion 111, 112, 113, 114 and 115 of the golf swing of a golf club 30, by the golfer 11 to strike the golf ball 20; and a mounting assembly 70 for releasably mounting the aiming assembly 40 on the head 15 of the golfer 11.

More specifically, the present invention relates to a golf training device 10 which includes an aiming assembly 40 having an aiming point 100, and which is directed towards a golf ball 20. The aiming point 100 assists a golfer 11 in positioning and maintaining the golfer's head 15, and body 12 in an appropriate orientation relative to the golf ball 20, so that the golfer 11 may continually view the aiming point 100 which is directed toward the golf ball 20 throughout a portion of a golf swing 134, and until the golfer 11 strikes 115 the golf ball 20 with the golf club 30 which is being swung by the golfer 11. The aiming assembly 40 includes, in one form of the invention, a selectively energizable light emitting device 41 which emits a light beam 60 which is pointed at the golf ball 20 to be struck, and which further forms the aiming point 100 on the golf ball 20. The aiming point 100 may be visibly discerned by an eye 16 of the golfer 11. The light emitting device 41 further comprises a tilt sensor 51 which is made operably integral with a light emitting device 41. The tilt sensor 51 selectively energizes the light emitting device 41 only when the light emitting device 41 is located in a non-horizontal orientation 125, and pointed generally downwardly, and in the direction of the golf ball 20 which is resting on an underlying supporting surface 21; and further deenergizes 137 the light emitting device 41 when the light emitting device 41 moves towards a horizontal orientation. The golf training device 10 further includes an angularly adjustable mounting assembly 70 for releasably mounting the aiming assembly 40 on the head 15 of the golfer 11.

The golf training device 10 of the present invention, as noted above, includes an aiming point 100 which is formed by the aiming assembly 40, and wherein the aiming device 40 is maintained on the golf ball 20 by the golfer 11 throughout a portion of the golf swing 134 so as to keep both the head 15, and the body 12, of the golfer 11, in an appropriate orientation relative to the golf ball 20 during the golf swing 110, and which results in an approved golfing performance of the golfer.

Figures 10A, 10B:
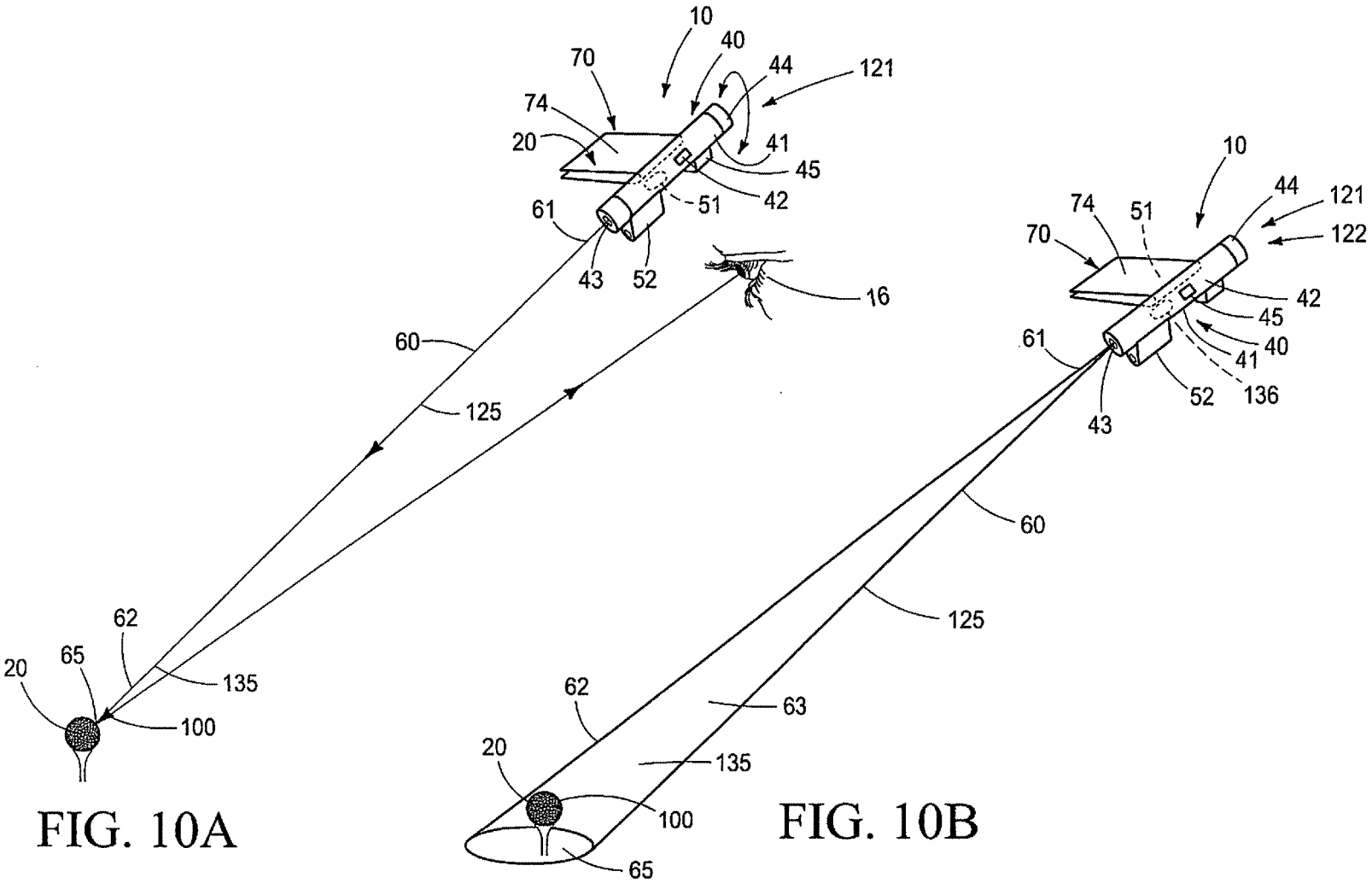
FIG. 10A is a greatly simplified perspective side elevation view of still another possible form of the invention.
FIG. 10B is a greatly simplified, perspective, side elevation view of yet another form of the invention.

The aiming point 100 formed by the light emitting device 41 on the golf ball 20 forms a predetermined illuminated region 65 on the golf ball 20, and which may have a cross-sectional dimension which can be adjusted by the golfer as the golfer's skills increase (compare FIGS. 10A and 10B). In addition to the foregoing, the golf training device 10 further has a form of the invention, and which includes a light receiving sensor 52 which is borne by the aiming device 40, and which further detects the emitted light 60 generated by the energized light emitting device 41, and which is reflected 64 by the golf ball 20; and an audio device 54 is operably coupled to the light receiving sensor 52, and which emits an audio sound 55 which is heard by the golfer 11 when the aiming point 100 formed by the aiming assembly 40 is moved away from, or off the golf ball 20 by the movement of the golfer's head 15, and/or body 12 during a golf swing 110. This novel feature encourages the golfer 11 to keep their head 15 in a correct, down position 132, and substantially motionless while swinging 134 the golf club 30. As should be understood, the ability of one form of the golf training device 10 to generate a light beam which has a user adjustable cross-sectional dimension, allows both novice, and more advanced golfers to utilize and benefit from the present device to train themselves, overtime, to have increasingly improved golf swings that have increased power, and accuracy because the golfer can maintain their head down, and motionless through at least a significant portion of every golf swing that they make.

Therefore it will be seen that the present invention avoids the shortcomings attendant with the prior art practices and methodology utilized, heretofore, and further addresses the issues associated with the golfer's vision, and the proper orientation of the golfer's head during a golf swing so as to increase the golfer's performance in a manner not possible, heretofore.

In compliance with the statute, the invention has been described in language more or less specific as to structural and methodological features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalence.

I claim:

1. A golf training device, comprising:

an aiming assembly having an aiming point which is directed toward a golf ball, and wherein the aiming point assists a golfer in positioning, and maintaining a golfer's head, and body, in an appropriate orientation relative to the golf ball so that a golfer continually views the aiming point which is directed toward the golf ball throughout a portion of a golf swing, and until the golfer strikes the golf ball with a golf club which is being swung by the golfer, and wherein the aiming assembly includes a selectively energizable light emitting device which emits a light beam which is pointed at the golf ball to be struck, and which forms the aiming point on the golf ball, and wherein the aiming point is visibly discerned by an eye of the golfer, and wherein the aiming point of the aiming device is maintained on the golf ball by the golfer throughout the portion of the golf swing so as to keep both the head and the body of the golfer in an appropriate orientation relative to the golf ball during the golf club swing, and which results in an improved golfing performance of the golfer, and wherein the aiming point formed by the light emitting device on the golf ball forms a predetermined illuminated region on the golf ball having a cross-sectional dimension which can be adjusted by the golfer, and wherein the light emitting device further comprises a tilt sensor which is made integral with the light emitting device, and wherein the tilt sensor selectively energizes the light emitting device only when the light emitting device is located in a non-horizontal orientation, and pointed generally downwardly, and in the direction of the golf ball which is resting on an underlying supporting surface, and further deenergizes the light emitting device when the light emitting device moves towards a horizontal orientation; and an angularly adjustable mounting assembly for releasably mounting the aiming assembly on the head of the golfer;

a light receiving sensor borne by the aiming device, and which detects the light beam generated by the energized light emitting device, and which is reflected by the golf ball; and an audio device operably coupled to the light receiving sensor, and which emits an audio sound that is heard by the golfer when the aiming point formed by the aiming assembly is moved away from the golf ball by the movement of the golfer's head and/or body during a golf swing so as to encourage the golfer to keep their head in a correct, down position, and substantially motionless while swinging the golf club.

2. A golf training method, comprising:

providing an aiming assembly which forms a visibly discernible aiming point formed of a light beam;

adjustably positioning the aiming assembly on a head of a golfer;

training the aiming point formed by the aiming assembly onto a golf ball which is to be struck by a golfer swinging a golf club during a golf swing by orienting a body, and a head of the golfer, in an appropriate standing position relative to the golf ball, and with the head of the golfer in a down, and relatively motionless position, so that the aiming point is visually directed onto the golf ball which is to be struck by the golf club during the golf swing, and which further can be visually discerned by the golfer;

moving the golf club through the golf swing so as to impact the golf ball while simultaneously visually maintaining the aiming point formed by the aiming assembly trained on the golf ball throughout at least a portion of the golf swing, and at least until the golf club impacts the golf ball, and wherein the golf training device encourages the golfer to maintain the golfer's head, and body, in the appropriate standing position, and with the head of the golfer in the down, and relatively motionless position relative to the golf ball, and during the golf swing, so as to achieve improved golfing performance;

providing a light receiving sensor, and mounting the light receiving sensor on the aiming device, and which detects the light beam generated by the aiming assembly, and which is reflected by the golf ball; and providing an audio device, and operably coupling the light receiving sensor to the audio device, and wherein the audio device emits an audio sound that is heard by the golfer when the aiming point formed by the aiming assembly is moved away from the golf ball by the movement of the golfer's head and/or body during a golf swing so as to encourage the golfer to keep their head in a correct, down position, and substantially motionless while swinging the golf club.

3. A golf training method as claimed in claim 2 and further comprising:

providing a tilt sensor which is made operably integral with the aiming assembly, and which selectively energizes the aiming assembly to produce the light beam;

energizing the aiming assembly by way of the operation of the tilt sensor by locating the aiming assembly in a non-horizontal orientation, and pointed generally downwardly, and in the direction of the golf ball which is resting on an underlying supporting surface; and deenergizing the aiming assembly by way of the operation of the tilt sensor by locating the laser in an increasingly horizontal orientation.

4. A golf training method as claimed in claim 3, and wherein the step of moving the golf club through the golf swing includes moving the golf club along a given path of travel, and into forcible contact with the golf ball so as to cause the golf ball to subsequently travel along a flight path which is generally co-linearly, and outwardly oriented relative to the path of travel of the golf club moving along the golf swing, and while golfer visually maintains the aiming point formed by the aiming assembly trained on the golf ball.

* * * * *